US006401287B1

(12) United States Patent
Corrado et al.

(10) Patent No.: US 6,401,287 B1
(45) Date of Patent: Jun. 11, 2002

(54) SYSTEM FOR CLEANING A WEB SUBSTRATE

(76) Inventors: Frank C. Corrado, 33 Gateway Rd., Rochester, NY (US) 14624; James W. Fischer, 118 Bellhurst Dr., Rochester, NY (US) 14617; Gary R. Larsen, 726 Eastwood Cir., Webster, NY (US) 14580; Ronald W. Sweet, 2234 E. Lake Rd., Conesus, NY (US) 14435

( * ) Notice: Subject to any disclaimer, the term of this patent is extended or adjusted under 35 U.S.C. 154(b) by 0 days.

(21) Appl. No.: 09/442,937

(22) Filed: Nov. 18, 1999

(51) Int. Cl.[7] ..... B08B 1/02
(52) U.S. Cl. ..... 15/3; 15/102
(58) Field of Search ..... 15/3, 100, 102

(56) References Cited

U.S. PATENT DOCUMENTS

| | | | | | |
|---|---|---|---|---|---|
| 1,701,639 | A | * | 2/1929 | Schulz | 15/100 X |
| 2,791,788 | A | * | 5/1957 | Hausdorf | 15/100 |
| 4,009,047 | A | | 2/1977 | Lindsay | 134/9 |
| 4,010,514 | A | * | 3/1977 | Fischer et al. | 15/100 X |
| 5,251,348 | A | | 10/1993 | Corrado et al. | 15/256.53 |
| 5,423,104 | A | * | 6/1995 | West | 15/100 |
| 5,611,281 | A | | 3/1997 | Corrado et al. | 101/425 |
| 5,699,738 | A | | 12/1997 | Corrado et al. | 101/425 |
| 5,725,104 | A | | 3/1998 | Walraven | 209/733 |
| 5,855,037 | A | | 1/1999 | Wieloch et al. | 15/256.5 |

FOREIGN PATENT DOCUMENTS

| | | | | |
|---|---|---|---|---|
| DE | 938905 | * | 2/1956 | 15/102 |
| DE | 1077960 | * | 3/1960 | 15/3 |
| GB | 435704 | * | 9/1935 | 15/100 |

* cited by examiner

*Primary Examiner*—Mark Spisich

(57) ABSTRACT

A system for cleaning first and second surfaces of a moving web substrate. First and second turret subsystems are disposed sequentially along the web path. Each turret is rotatable about an axis transverse to the direction of web conveyance but there is no axial cross-shaft. Each turret includes at least two contact cleaning rollers spaced apart in the turret on opposite sides of the turret axis. The web path proceeds through each pair of rollers such that in each turret the first roller of the pair is adjacent a first surface of the web and the second roller of the pair is adjacent a second surface of the web. When the turrets are rotated to a null position, none of the rollers is in contact with the web. When the turrets are rotated to a web cleaning position, the web is engaged with the rollers on both sides of the web and follows a serpentine path through the turrets. In a preferred embodiment, each turret is provided with four rollers such that any pair of rollers in either turret may be cleaned at any time without breaking continuity of cleaning of the web surfaces by two rollers on each web surface.

8 Claims, 7 Drawing Sheets

SYSTEM FOR CLEANING A WEB SUBSTRATE

DESCRIPTION

The present invention relates to apparatus for cleaning particulate contamination from the surfaces of web substrates; more particularly to cleaning apparatus having a plurality of particle-attracting ("contact cleaning") rollers for transferring particulate contamination from a web surface to the surfaces of the rollers; and most particularly, to such apparatus whereby both surfaces of a web may be cleaned simultaneously and wherein the rollers may be moved out of contact with the web as desired, and especially when the web is stationary.

It is well known to convey a web substrate around a particle-attracting roller to cause particulate contaminants on the surface of the web substrate to be transferred to the surface of the roller, thereby cleaning the web substrate. Such rollers are known in the art as "contact cleaning rollers" (CCR's), and may be provided with a tacky surface comprising, for example, adhesive tape as disclosed in U.S. Pat. No. 4,009,047, or an electrostatically-active polymeric surface, for example, a polyurethane as disclosed in U.S. Pat. Nos. 5,611,281 and 5,699,738.

The surface of a contact cleaning roller becomes progressively clogged with particles during use, reducing its effectiveness; therefore, the roller surface requires cleaning or " renewal"from time to time. Typically, renewal involves the use of liquid agents such as water or solvents to release the particles from the roller surface. Renewal typically leaves the surface of the roller wet for a short time. Experience has shown that if renewal is attempted while a CCR is in working contact with a substrate, the cleaning fluid can be tracked undesirably onto the substrate. Various multiple-roller schemes have been proposed to permit engaging a fresh CCR with a web and disengaging a particle-loaded CCR for cleaning while maintaining continuous cleaning of the web substrate. See, for example, the above-cited U.S. Pats., and also U.S. Pat. No. 5,251,348 ('348).

Patent '348 discloses an axially rotatable turret disposed transversely of the conveyance path of a web substrate, the turret supporting three equidistantly-spaced contact cleaning rollers adjacent one surface of the web to be cleaned. In the rest position of the turret, two rollers are in rolling contact with the moving web, and the third roller is in a cleaning position for renewal. When the third roller has been cleaned and dried, it may be re-engaged with the web by rotating the turret 120° to a new rest position, which also brings one of the other two rollers out of contact with the web and into position for cleaning. Thus, refreshed rollers may be continually supplied as needed without breaking continuity of cleaning contact of the web with one or more contact cleaning rollers.

The '348 apparatus has been found to present a serious shortcoming when used to clean some delicate substrates, especially substrates having one or more fragile coatings on the surface being cleaned. When conveyance of the web is interrupted and the web is allowed to remain in stationary contact with the contact cleaning rollers for a period of time, the web surface can become adhered to the roller such that when conveyance is resumed the coating is stripped from the substrate and remains attached to the roller.

U.S. Pat. No. 5,855,037 discloses a scheme for preventing such adherence and stripping by periodically rotating the turret by a few degrees either clockwise or counterclockwise to bring new portions of the cleaning rollers and web into contact and to break contact between previously-contacting portions thereof before adherence can occur. Such periodic turret rotation can be operationally awkward as well as dangerous to operators, especially if it must be conducted every few seconds. Further, cleaning or change-out of the third roller during such a short rest interval may be impossible. In the extreme, web substrates which adhere very quickly or readily may not be cleaned safely using this apparatus, which cannot disengage all CCR's from the web under any circumstances.

It is a principal object of the invention to provide improved web cleaning apparatus which can a) provide contact with a plurality of contact cleaning rollers during normal operation; b) provide easy cleaning or change-out of every contact cleaning roller in the apparatus; c) provide continuous contact, if desired, with at least one cleaning roller during all periods of web conveyance; d) disengage all contact cleaning rollers from the web whenever desired, whether the web is being conveyed or is stationary; and e) clean both surfaces of the web simultaneously.

It is a further object of the invention to provide improved web cleaning apparatus wherein the apparatus can be stopped mechanically and turned off electrically when fully disengaged from the web substrate.

Briefly described, a system for cleaning first and second surfaces of a web substrate being conveyed along a conveyance path includes first and second turret subsystems disposed sequentially along the path. Each turret is rotatable about an axis transverse to the direction of web conveyance but there is no axial cross-shaft. Each turret includes at least two contact cleaning rollers spaced apart in the turret. Preferably the rollers are disposed 180° apart such that the axes of the rollers and the axis of the turret are contained in a plane. The web path proceeds through each pair of rollers such that in each turret the first roller of the pair is adjacent a first surface of the web and the second roller of the pair is adjacent a second surface of the web. When the turret is rotated sufficiently, neither of the rollers is in contact with the web (null position). When the turret is rotated to another position such that the plane forms an acute angle with the web path, preferably about 45° or less, the web is engaged with the rollers on both sides of the web and follows a serpentine path through the turret.

In operation for web cleaning, at least one of the turrets is rotated to such a position that both rollers are engaged with the web. When it becomes necessary to renew one or both of the engaged rollers, the second turret may be rotated into engaged position such that both rollers in both turrets are engaged with the web. After the portion of the web between the turrets has passed through the downstream turret, the first turret may be rotated to disengage its rollers which then may be renewed and readied for re-engagement.

In a presently preferred embodiment, at least one of the turrets is provided with a second pair of contact cleaning rollers disposed in the turret in a second plane oriented at preferably 90° from the plane containing the axes of the first rollers. In this embodiment, the spacing and diameters of the rollers are selected such that when the turret is rotated to a position in which both planes form an angle of 45° to the web path, all four rollers are disengaged from the web substrate. From this position, when the turret is rotated through a suitable angle in either direction, for example, about 45°, one pair of rollers is fully engaged in cleaning position and the other pair of rollers is in renewal position. In this embodiment, the second turret assures continuity of cleaning as the first turret passes through the null position in rotating between a first cleaning position and a second cleaning position.

In a further preferred embodiment of the invention, each turret is provided with four rollers such that any pair of rollers in either turret may be rotated into renewal position at any time without breaking continuity of cleaning of the web surfaces.

In a further preferred embodiment of the invention, non-cleaning backing rollers are provided outside the turrets against which the contact cleaning rollers, in being rotated by the turrets, can nip the moving web, thereby increasing substantially the cleaning effectiveness of the contact cleaning rollers.

The foregoing and other objects, features, and advantages of the invention, as well as presently preferred embodiments thereof, will become more apparent from a reading of the following description in connection with the accompanying drawings in which.

Figure 1:
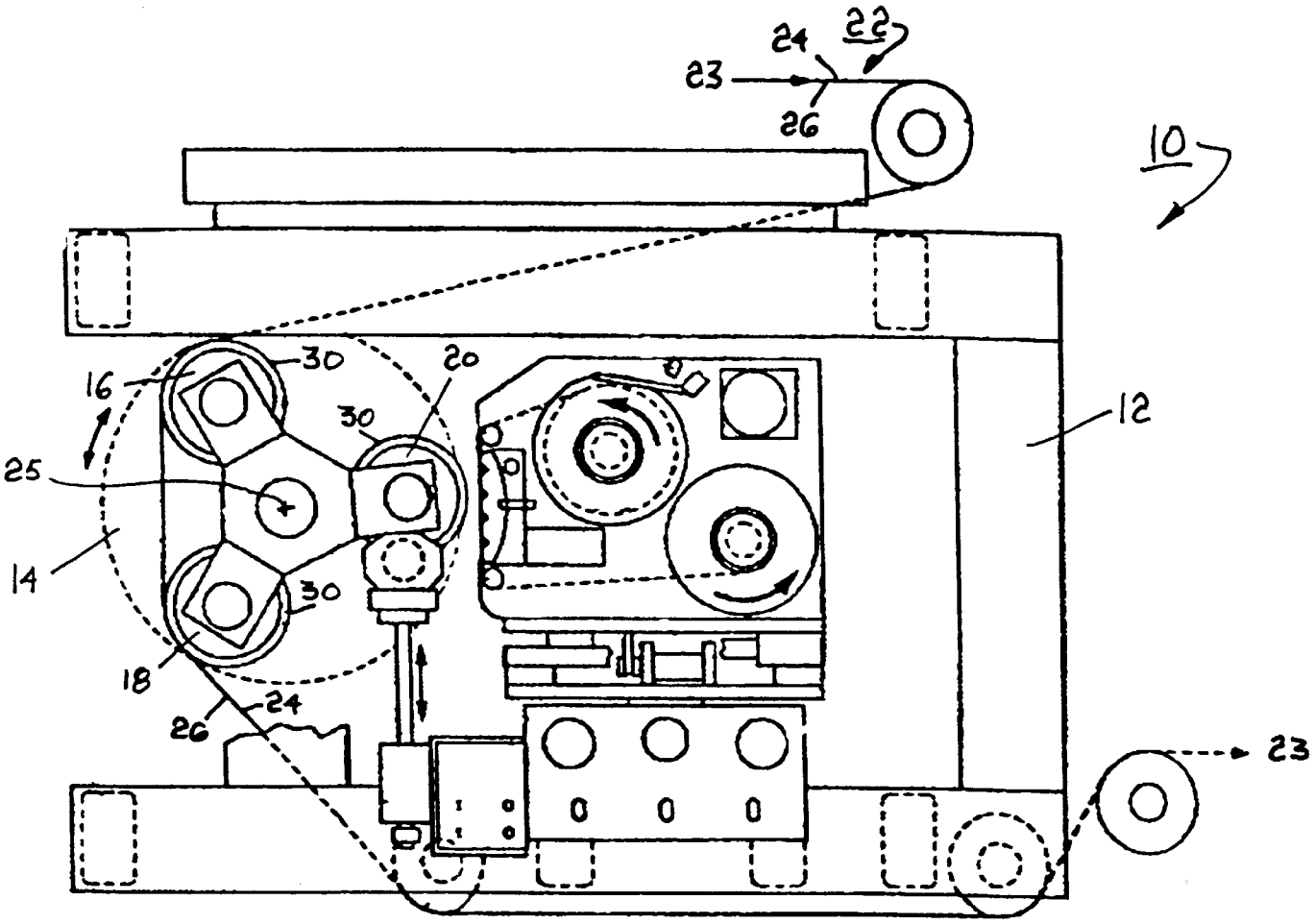
FIG. 1 (PRIOR ART)
FIG. 1 is an elevational cross-sectional view of a prior art turreted contact cleaning roller apparatus, showing the web path passing around the contact cleaning rollers in the turret.

Referring to FIG. 1, a prior art contact cleaning roller apparatus 10 includes a frame 12 supporting a turret 14 containing three equilaterally-spaced contact cleaning rollers 16,18,20. Turret 14 and rollers 16,18,20 are disposed transversely of a web 22 having first and second surfaces 24,26, web 22 being conveyable through apparatus 10 along a web path 23. Turret 14 is programmably rotatable about axis 25 to bring the surfaces 30 of rollers 16,18,20 into cleaning contact with surface 24 of web 22. The path 23 of web 22 extends around the periphery of turret 14 so that at any given time, at least two of rollers 16,18,20 are in contact with surface 24. As disclosed in U.S. Pat. No. 5,855,037, while the web is stationary, as during a shutdown or maintenance, turret 14 may be rotated about axis 25 sequentially between the clockwise and counterclockwise directions to cause the rollers to roll a short distance along the stationary web "to bring a fresh area of cleaner rolls into contact with the web and to separate from the web those areas of the cleaner rolls that were previously in contact with the web." This action is intended to prevent delamination of coatings on the web upon restarting of the web conveyance system.

Figure 3:
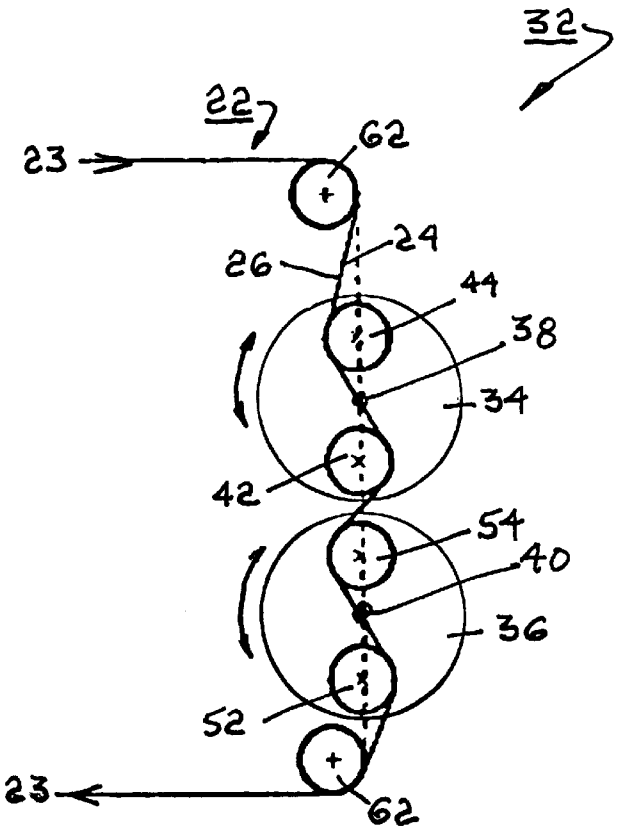
FIG. 3 is a schematic elevational cross-sectional view of the system shown in FIG. 2, showing the two contact cleaning rollers in each turret engaged with the web in cleaning position.
Figure 2:
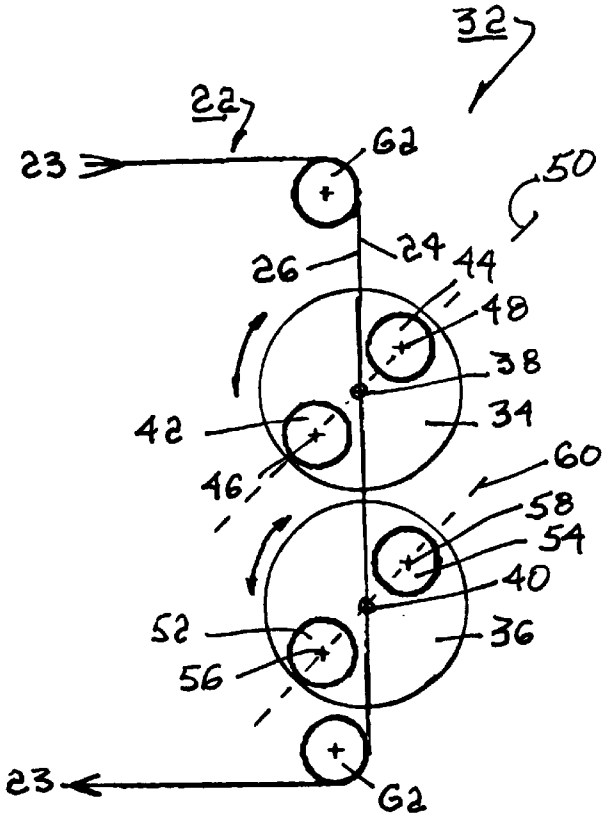
FIG. 2 is a schematic elevational cross-sectional view of a first embodiment of a two turret contact cleaning roller system in accordance with the invention, each turret having two rollers, showing the rollers in a non-contact, or null, position, and showing the web passing between the contact cleaning rollers in the turrets.

Referring to FIGS. 2 and 3, a contact cleaning roller system 32 in accordance with the invention for cleaning a web 22 conveyable along a web path 23 includes a first turret 34 and a second turret 36, each rotatable about its respective axis 38,40. The axes of turrets 34,36 are substantially parallel and are oriented substantially orthogonal to the direction of travel of web 22 along path 23. Turret 34 is provided with first and second contact cleaning rollers 42,44 having respective rotation axes 46,48 substantially parallel to each other and to turret axis 38 and disposed in the turret such that, preferably, axes 38,46,48 are contained in plane 50. Similarly, turret 36 is provided with first and second contact cleaning rollers 52,54 having respective rotation axes 56,58 substantially parallel to each other and to turret axis 40 and disposed in the turret such that, preferably, axes 40,56,58 are contained in plane 60. Web path 23 proceeds through turrets 34 and 36, passing between rollers 42 and 44 and between rollers 52 and 54 so that rollers 42 and 52 are adjacent second surface 26 of web 22 and rollers 44 and 54 are adjacent first surface 24 of web 22. In the null position, as shown in FIG. 2, none of the cleaning rollers is in contact with web 22. The web path through the turrets is directed by idle guide rollers 62. In the null position, the turrets may be shut down electrically and the rollers and turret mechanisms may be cleaned or otherwise manipulated without risk of damaging contact between the roller surfaces and the web surfaces, and without hazard to operators, as can occur in the prior art cleaning apparatus shown in FIG. 1.

Contact cleaning rollers suitable for use in accordance with the invention are available from, for example, Polymag Tek Inc., Rochester, N.Y. USA.

Referring to FIG. 3, turrets 34 and 36 are rotated approximately 45° counterclockwise from their positions as shown in FIG. 2, to bring rollers 42 and 52 into cleaning contact with web surface 26 and rollers 44 and 54 into cleaning contact with web surface 24. In this configuration, each surface of the web is cleaned simultaneously by two contact cleaning rollers. When any of the rollers requires renewal, either supporting turret may be rotated back to the null position shown in FIG. 2 for roller renewal, the other pair of cleaning rollers remaining in cleaning contact with the web to maintain continuity of cleaning.

Figure 5:
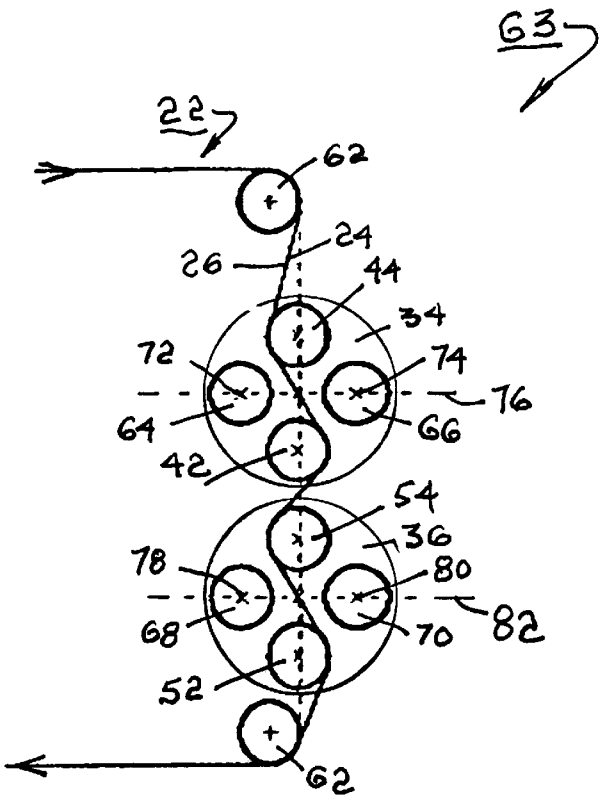
FIG. 5 is a schematic elevational cross-sectional view of the system shown in FIG. 4, showing two contact cleaning rollers in each turret engaged with the web in cleaning position and two rollers in each turret in renewal position.
Figure 4:
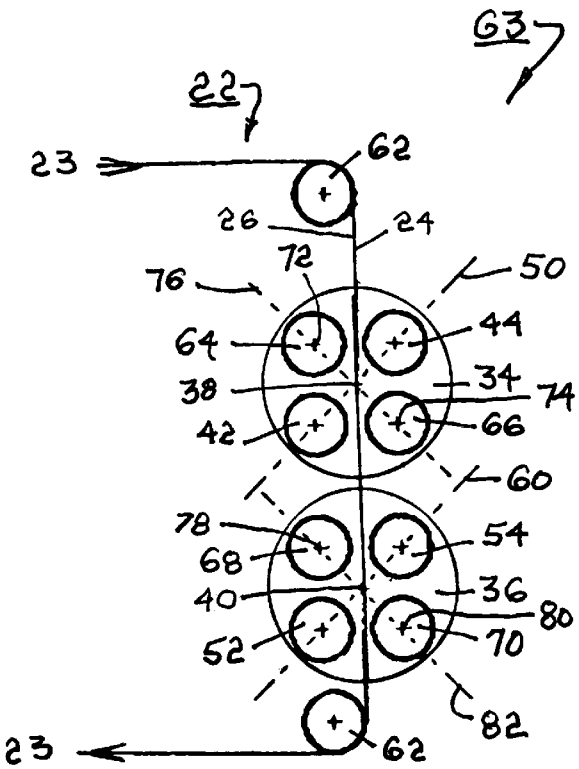
FIG. 4 is a schematic elevational cross-sectional view of a second embodiment of a two-turret contact cleaning roller system in accordance with the invention, each turret having four rollers, showing the rollers in a null position.

If it is desired to maintain two cleaning rollers in contact with each side of the web during all periods of cleaning, third and fourth contact cleaning rollers 64,66 may be added to first turret 34, and third and fourth contact cleaning rollers 68,70 may be added to second turret 36, as shown in embodiment 63 in FIGS. 4–9. Preferably, axes 72,74 of rollers 64,66, respectively, are contained in a plane 76 including first turret axis 38; and axes 78,80 of rollers 68,70, respectively, are contained in a plane 82 including second turret axis 40. Preferably, planes 76 and 50 intersect at substantially a 90° angle, as do planes 82 and 60. As shown in FIG. 4, when planes 50,60,76,82 intersect web path 23 at a 45° angle, all contact cleaning rollers are fully disengaged from both surfaces of the web. As shown in FIG. 5 (and as in FIG. 3), when turrets 34 and 36 are rotated approximately 45° counterclockwise from their null positions as shown in FIG. 4, rollers 42 and 52 are brought into cleaning contact with web surface 26 and rollers 44 and 54 into cleaning contact with web surface 24, while rollers 64 and 68 are brought to upper and lower, respectively renewal positions on the surface 26 side of the web and rollers 66 and 70 are brought to similar upper and lower, respectively renewal positions on the surface 24 side of the web. In this configuration, each surface of the web is cleaned simultaneously by two contact cleaning rollers. When any of rollers 42,44,52,54 requires renewal, the appropriate turret may be rotated through its null position to bring that roller into renewal position, the other pair of cleaning rollers on that turret being brought into cleaning contact with the web to maintain continuity of two-roller cleaning on each side of the web.

Figure 6:
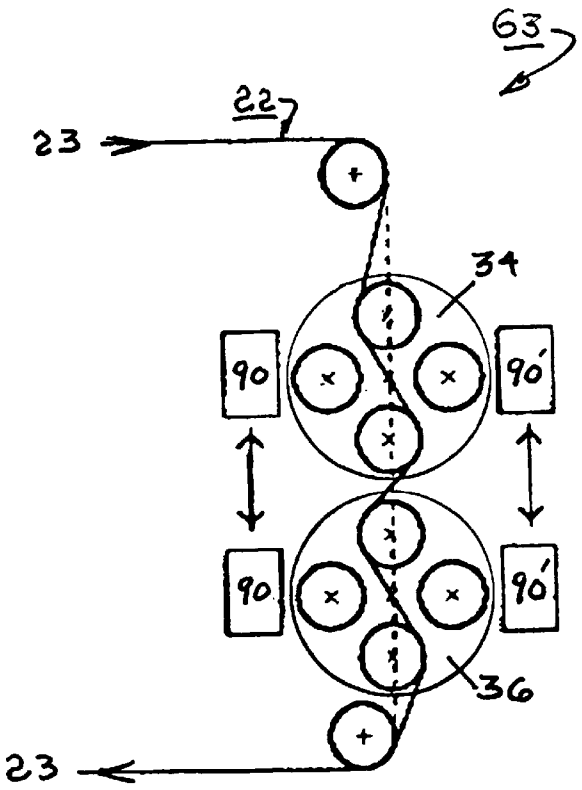
FIG. 6 is a schematic elevational cross-sectional view like that shown in FIG. 5, showing a preferred embodiment of cleaning apparatus for renewing the contact cleaning rollers in renewal position.

Rollers in renewal position may be cleaned by any of several known cleaning techniques, for example, cleaning apparatus and methods as disclosed in any of U.S. Pat. Nos. 5,251,348, 5,725,104, and 5,611,281, the relevant disclosures of which are hereby incorporated by reference. Because turrets 34 and 36 are substantially identical in layout, it is possible, and generally preferable, to provide one roller renewal apparatus 90,90' on each side of the web and to provide means for moving the apparatus between the upper and lower cleaning positions, as shown in FIGS. 6 and 7.

We have found that nip roller cleaning can be substantially more effective than free-span cleaning in removing particles from a web substrate. In nip roller cleaning, the moving web passes through a pressure nip between a contact cleaning roller on the side of the web being cleaned and a backing roller on the other side of the web, unlike free-span cleaning in which the web has no backing support urging it toward the cleaning roller. The cleaning modes discussed herein previously are all free-span.

Figure 7:
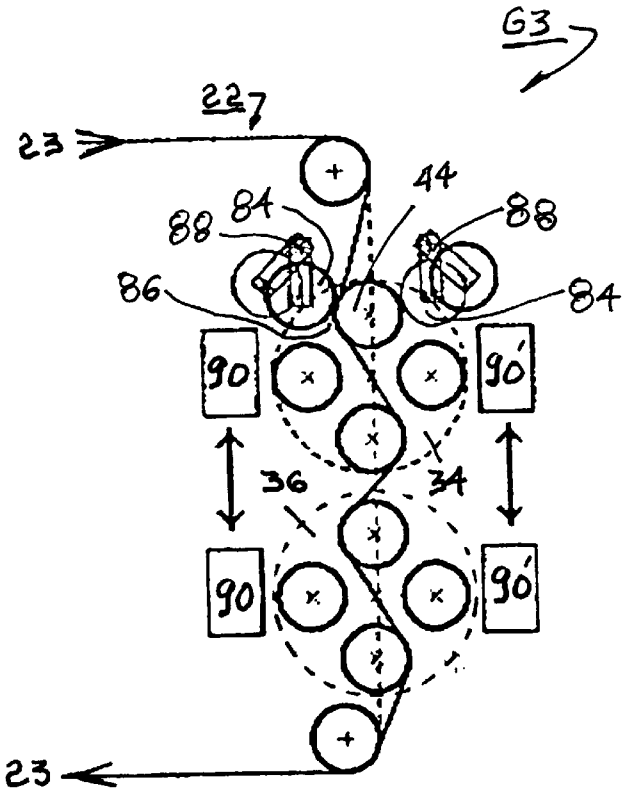
FIG. 7 is a schematic elevational cross-sectional view like that shown in FIG. 6, showing the addition of pivotable backing rollers for nip engagement of the web by the contact cleaning rollers.

As shown in FIG. 7, idler backing rollers 84 may be provided to embodiment 63 to provide, for example, a nip 86 between backing roller 84 and cleaning roller 44. To facilitate operational rotation of the turrets, it may be necessary to mount the backing roller 84 on a pivot arm 88 such that roller 84 can be pivoted out of the translational path of other contact cleaning rollers during rotation of the turret.

Figure 10:
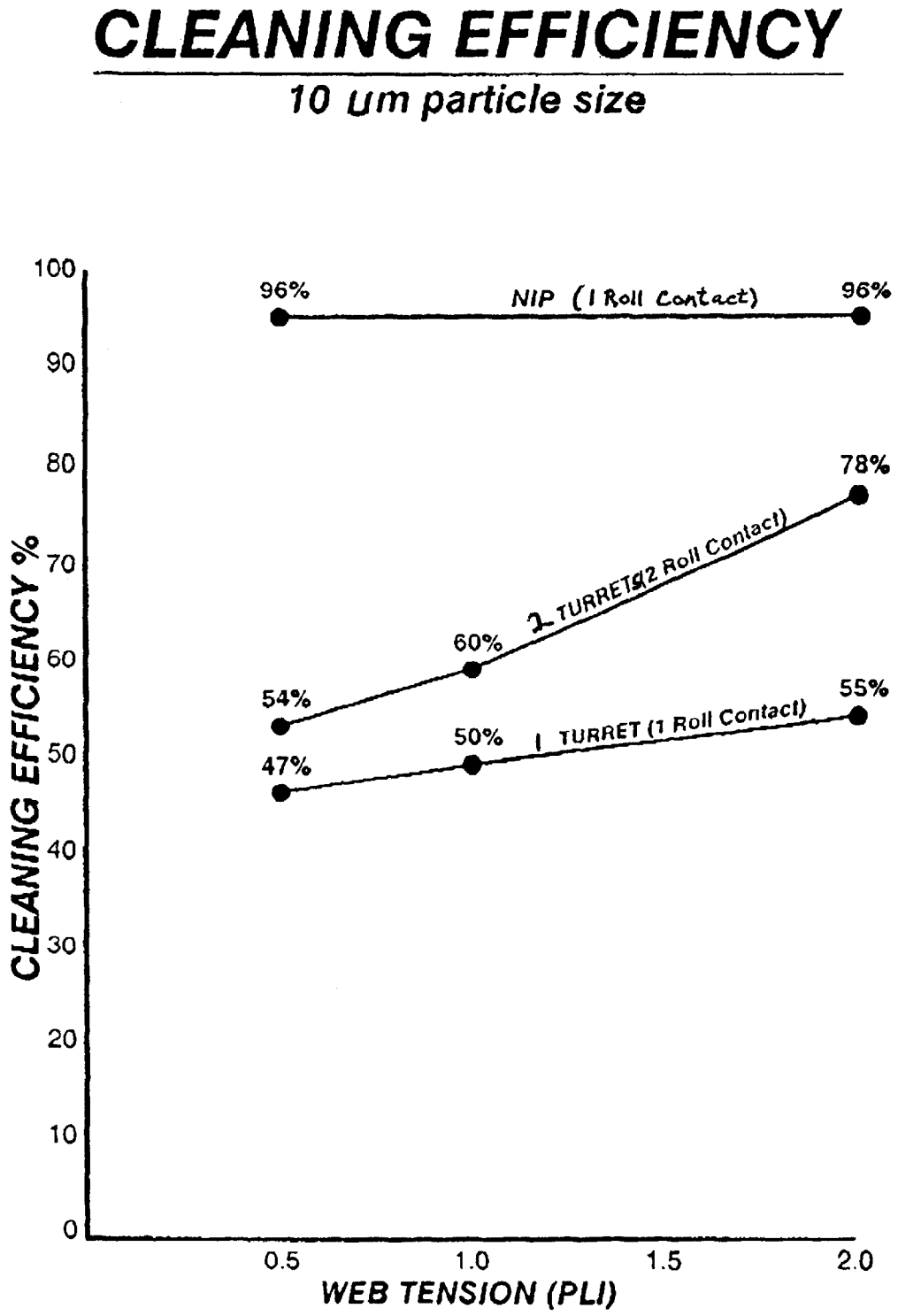
FIG. 10 is a graph showing the particle-removal effectiveness of systems having one contact cleaning roller in contact with the web (one turret), two contact cleaning rollers in contact with the web (two turrets), and a contact cleaning roller in nipped relationship with a backing roller.

The improvement in cleaning provided by a nip roller is shown in FIG. 10. In tests of removing particles 10 $\mu$m in diameter from a web surface at various web tensions, expressed in pounds of tension per linear inch of web width, a single free-span cleaning roller removed between 47% and 55% of the particles; two successive free-span rollers removed between 54% and 78% of the particles; and a single nipped cleaning roller removed 96% of the particles at all web tensions tested.

Figure 8:
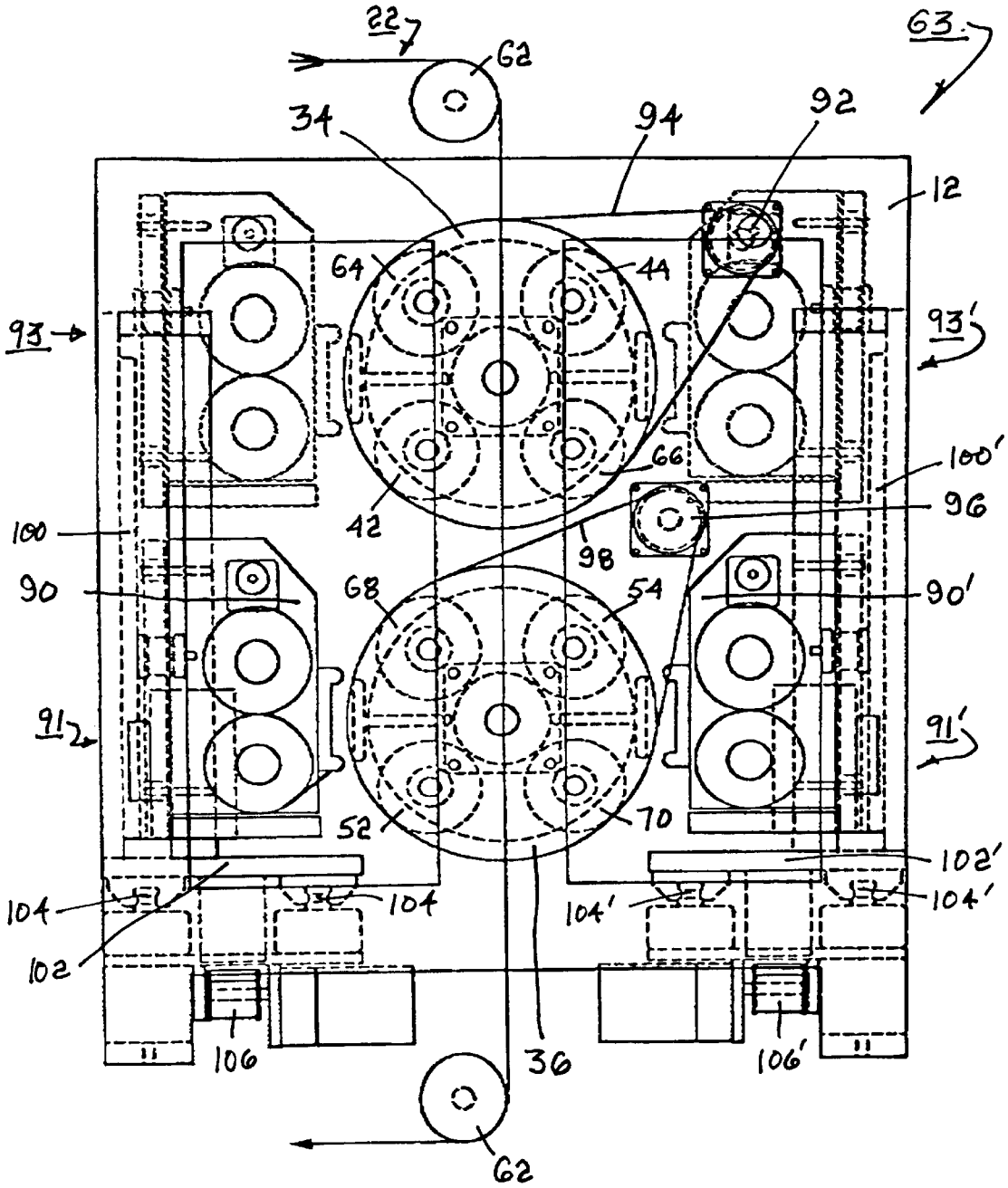
FIG. 8 is a side elevational view, partially in cross section, of a preferred embodiment of a two-turret contact cleaning roller system in accordance with the invention, being a detailed view of the apparatus shown schematically in FIG. 4.
Figure 9:
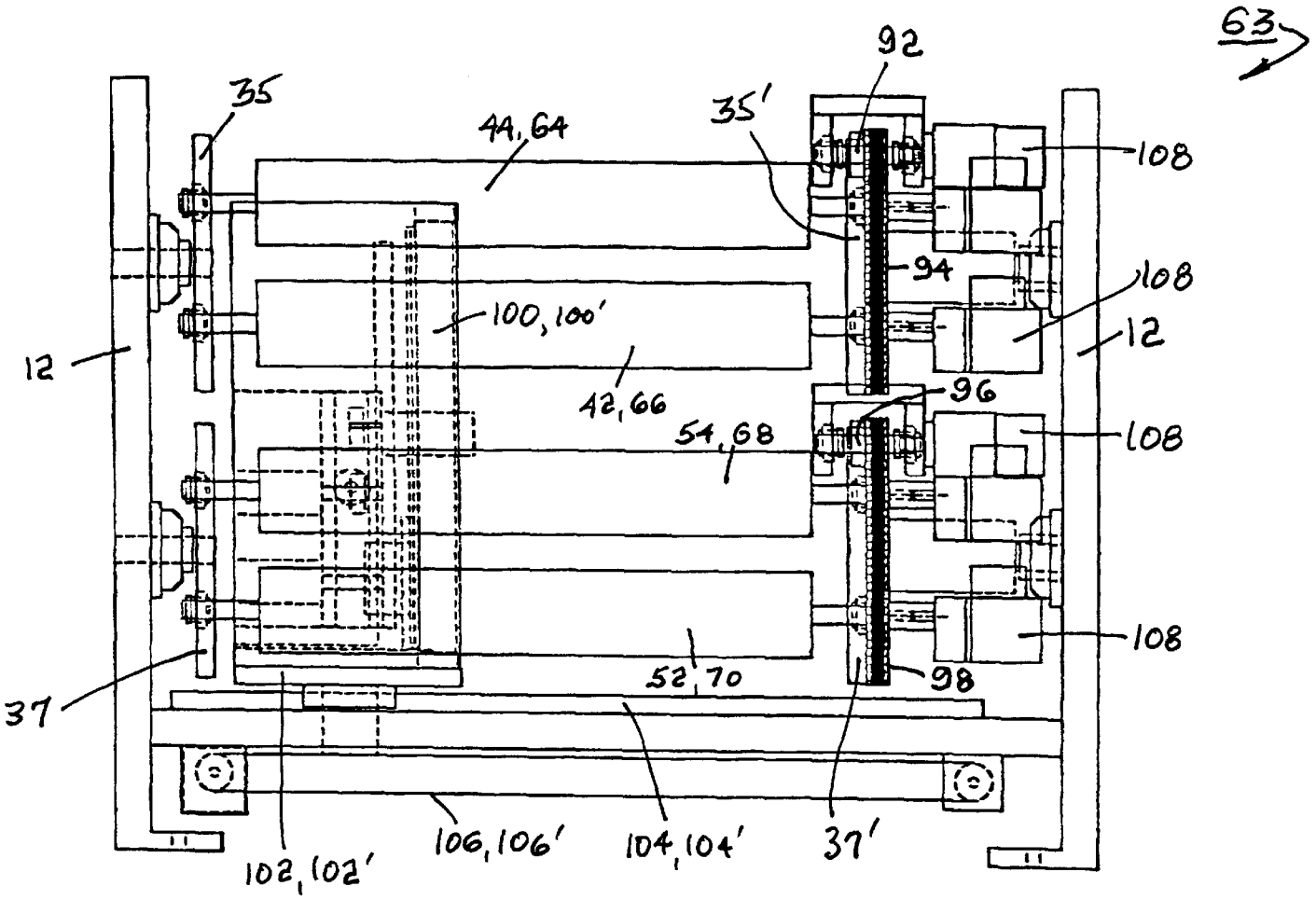
FIG. 9 is a front elevational view of the apparatus shown in FIG. 8.

FIGS. 8 and 9 show a detailed view of a two-turret cleaning apparatus in accordance with the invention, and as shown previously and schematically as embodiment 63 in FIG. 6. First and second turrets 34,36 having first and second turret flanges 35,35' and 37,37', respectively, are rotatably supported on a frame 12. First turret 34 is provided with contact cleaning rollers 42,44,64,66 disposed longitudinally between flanges 35,35', and second turret 36 is provided with contact cleaning rollers 52,54,68,70 disposed longitudinally between flanges 37,37'. First turret 34 is rotatably connected to a first programmable drive 92 via first belt or chain 94, or by other conventional apparatus such as, for example, by direct shaft drive, and second turret 36 is rotatably connected to a second programmable drive 96 via second belt or chain 98. The coordination of turret rotation and positioning is controlled conventionally by a programmable controller or computer (not shown). Roller cleaners 90,90', shown in FIG. 9 in solid lines in the lower position 91,91' and in dotted lines in the upper position 93,93', are mounted on vertical rails 100,100' for movement between the lower and upper positions. Rails 100,100' are supported by platforms 102,102' slidably mounted on horizontal rails 104,104' to permit cleaners 90,90' to be oscillated axially of the rollers by toothed belts 106,106' or other oscillatory mechanism, as is disclosed in the incorporated references.

Preferably, all eight of the contact cleaning rollers are provided with means 108 for matching the linear surface speed of the roller to the linear conveyance speed of the web prior to engagement of renewed rollers with the web, to prevent potential scuffing of the web. Suitable speed matching means is disclosed in the incorporated references.

From the foregoing description, it will be apparent that there has been provided an improved system for cleaning web substrates, wherein a plurality of contact cleaning rollers may be engaged with both surfaces of the web simultaneously, and wherein all contact cleaning rollers may be disengaged simultaneously from the web. Variations and modifications of the herein described web cleaning system, in accordance with the invention, will undoubtedly suggest themselves to those skilled in this art. Accordingly, the foregoing description should be taken as illustrative and not in a limiting sense.

What is claimed is:

1. A system for cleaning particulate contamination from first and second surfaces of a web substrate being conveyed in a conveyance direction along a web path, comprising a first turret having a first axis of rotation disposed transversely of said web conveyance direction and having first and second contact cleaning rollers in said first turret disposed transversely of said web conveyance direction on opposite sides of said first turret axis of rotation and on opposite sides of said web path so that said web path passes between said first and second contact cleaning rollers, said first turret being rotatable about said axis such that said first and second contact cleaning rollers in said first turret may be engaged into cleaning position with said first and second surfaces of said web substrate and may be disengaged from said first and second surfaces of said web substrate into a null position, said first and second contact cleaning rollers being driven by contact with said first and second web surfaces respectively and turning synchronously therewith; said system further comprising a second turret spaced apart along said web path from said first turret, having a second axis of rotation disposed transversely of said web conveyance direction and having first and second contact cleaning rollers in said second turret disposed transversely of said web conveyance direction on opposite sides of said second turret axis of rotation and on opposite sides of said web path so that said web path passes between said first and second contact cleaning rollers, said second turret being rotatable about said axis such that said first and second contact cleaning rollers in said second turret may be engaged into cleaning position with said first and second surfaces of said web substrate and may be disengaged from said first and second surfaces of said web substrate into a null position, said first and second contact cleaning rollers in said second turret being driven by contact with said first and second web surfaces respectively and turning synchronously therewith; said system further comprising third and fourth contact cleaning rollers disposed transversely of and adjacent opposite sides of said web in said first turret so that said web path passes between said third and fourth contact cleaning rollers.

2. A system in accordance with claim 1, further comprising third and fourth contact cleaning rollers disposed transversely of and adjacent opposite sides of said web in said second turret so that said web path passes between said third and fourth contact cleaning rollers.

3. A system in accordance with claim 1, further comprising means for cleaning said contact cleaning rollers.

4. A system in accordance with claim 1 further comprising means for cleaning said contact cleaning rollers wherein said means for cleaning further comprises means for disposing roller cleaning apparatus in a first cleaning position adjacent said first turret and in a second cleaning position adjacent said second turret and for moving said apparatus between said first and second positions.

5. A system in accordance with claim 1 further comprising means for cleaning said contact cleaning rollers and further comprising means for moving said cleaning means axially of said contact cleaning rollers.

6. A system in accordance with claim 1 further comprising programmable means for rotating said turrets and for controlling said rotation.

7. A system for cleaning particulate contamination from first and second surfaces of a web substrate being conveyed in a conveyance direction along a web path, comprising a first turret having a first axis of rotation disposed transversely of said web conveyance direction and having first and second contact cleaning rollers in said first turret disposed transversely of said web conveyance direction on opposite sides of said first turret axis of rotation and on opposite sides of said web path so that said web path passes between said first and second contact cleaning rollers, said first turret being rotatable about said axis such that said first and second contact cleaning rollers in said first turret may be engaged into cleaning position with said first and second surfaces of said web substrate and may be disengaged from said first and second surfaces of said web substrate into a null position, said first and second contact cleaning rollers being driven by contact with said first and second web surfaces respectively and turning synchronously therewith, said system further comprising at least one backing roller disposed transversely of said web path and adjacent an opposite surface of said web substrate from a one of said contact cleaning rollers for engaging said web in nipped relation therebetween.

8. A system in accordance with claim 7 wherein said backing roller is pivotably mounted on a pivot arm for rotation out of the translational path of said contact cleaning rollers during rotation of said turret including said one of said contact cleaning rollers.

* * * * *